US005424268A

United States Patent [19]

Fehervari et al.

[11] Patent Number: 5,424,268

[45] Date of Patent: Jun. 13, 1995

[54] IMAGING MEDIUM AND PROCESS

[75] Inventors: Agota F. Fehervari, Lexington, Mass.; Russell A. Gaudiana, Merrimack, N.H.; Eric S. Kolb, Ipswich, Mass.; Parag G. Mehta, Peabody, Mass.; Lloyd D. Taylor, Lexington, Mass.; John C. Warner, Norwood, Mass.

[73] Assignee: Polaroid Corporation, Cambridge, Mass.

[21] Appl. No.: 242,726

[22] Filed: May 13, 1994

[51] Int. Cl.[6] ..... B41M 5/035; B41M 5/38

[52] U.S. Cl. ..... 503/227; 427/151; 428/195; 428/913; 428/914; 503/216; 503/217; 503/218

[58] Field of Search ..... 427/151; 428/195, 913, 428/914; 8/471; 503/216–218, 227

[56] References Cited

U.S. PATENT DOCUMENTS

| | | | |
|---|---|---|---|
| 3,929,760 | 12/1975 | Landholm et al. | 260/197 |
| 4,138,557 | 2/1979 | Boie et al. | 544/183 |
| 4,957,847 | 9/1990 | Adam et al. | 430/170 |
| 5,011,811 | 4/1991 | Shuttleworth et al. | 503/201 |

FOREIGN PATENT DOCUMENTS

| | | | |
|---|---|---|---|
| 106357 | 4/1984 | European Pat. Off. | 430/200 |
| 3422455 | 6/1984 | Germany | 430/200 |

OTHER PUBLICATIONS

Bello et al., J. Chem. Soc. Perkin Trans. II, 1987, 815.
Bello et al., J. Chem. Soc., Chem. Commun., 22, 1639 (1986).
Chemical Abstracts, 100, 193, 535t (Abstract of Japanese Pat. Appn. 82–123, 934, Pubn. No. 59–12,969).
Chemical Abstracts, 101, 173,032u (Abstract of Japanese Pat. App. 83–376, Pubn. No. 59–124,955).
Chemical Abstracts, 105, 105,845u (Abstract of Japanese Pat. App. 84–78,163, Pubn. No. 60–220,785).
Chemical Abstracts, 93, 48539e (Abstract of British Patent Application 2,026,528).
Chemical Abstracts, 94, 4953b (Abstract of French Patent Application 2,438,045).
Ford et al., J. Org. Chem., 32,173 (1967).
Hirao et al., Macromolecules, 21,561 (1988).

*Primary Examiner*—Bruce H. Hess
*Attorney, Agent, or Firm*—David J. Cole

[57] ABSTRACT

An imaging process uses an imaging medium comprising a polymer having a plurality of first groups. This polymer is imagewise contacted with an imaging reagent comprising a plurality of second groups, thus causing, in the areas of the medium exposed to the imaging reagent, the second groups to react with the first groups and form a colored material, and thereby forming an image on the imaging medium. One of the first and second groups comprises a benzotriazinone or benzothiatriazine-4,4-dioxide benzotriazinone moiety and the other comprises a naphthol or a pyrazalone moiety.

17 Claims, 2 Drawing Sheets

IMAGING MEDIUM AND PROCESS

BACKGROUND OF THE INVENTION

This invention relates to an imaging medium and to a process for producing an image. This invention also relates to a polymer useful in the imaging medium of the invention.

So-called "dye diffusion thermal transfer" imaging processes are known which use a receiving sheet and a donor sheet containing a dye. The two sheets are brought close together and the donor sheet is imagewise heated to cause the dye to diffuse to the receiving sheet, on which an image is formed. The donor sheet is then discarded. Full color images can be formed by multiple imagewise heating steps, using a different donor sheet on each pass; for example, a full color image can be formed using cyan, magenta, yellow and (optionally) black donor sheets.

Dye diffusion thermal transfer processes can produce high quality, continuous-tone images, but do suffer from a number of disadvantages. The heating of the donor sheet is typically effected using a thermal head which is scanned in a raster pattern across the donor sheet. The large number of pixels which must be heated on each donor sheet, coupled with the need for multiple donor sheets and for a reasonable total imaging time, require that the residence time of the thermal head on each pixel be short, typically of the order of milliseconds. If a high molecular weight dye is employed, large amounts of energy are required to transfer the dye from the donor sheet to the receiving sheet within this limited residence time. If, on the other hand, a low molecular weight dye is employed, the amount of energy needed for imaging is reduced, but the dye tends to diffuse through the receiving sheet, and such diffusion blurs the image. Low molecular weight dyes also tend to "bleed" from the receiving sheet on to any objects which the image contacts, for example the fingertips of users handling the image, or the pages of albums in which the images are stored.

U.S. Pat. No. 4,957,847 describes a thermal recording medium and process which is effectively a modification of a dye diffusion thermal transfer process. In the process of this patent, color is formed by the reaction between two separate components, namely a benzotriazine compound and a coupling component, which is preferably a naphthol. When used in a dye diffusion thermal transfer type process, one of the benzotriazine compound and the naphthol is coated on the donor sheet and the other is coated on the receiving sheet. Imagewise heating of the donor sheet causes the component thereon to diffuse to the receiving sheet, react with the other component, and form the image. The component which is required to diffuse is of course of lower molecular weight than the dye which forms the final image, and hence the energy requirements for imaging are lowered. However, the colored coupling product is a relatively low molecular weight material which is still susceptible to diffusion within the receiving sheet or on to objects which contact this sheet.

This invention relates to a modification of the imaging medium and process described in the aforementioned patent. The present process allows the diffusible component to be of low molecular weight, while providing a final colored material which is of high molecular weight and is thus much less susceptible to diffusion within or out of the receiving sheet.

SUMMARY OF THE INVENTION

This invention provides a process for forming an image. This process comprises providing an imaging medium comprising a polymer having a plurality of first groups; and imagewise contacting the polymer with an imaging reagent comprising a plurality of second groups, thus causing, in the areas of the medium exposed to the imaging reagent, the second groups to react with the first groups and form a colored material, and thus forming an image on the imaging medium. In the present process, one of the first and second groups comprises a benzotriazinone moiety bearing an electron-withdrawing group at the 3-position, or a benzothiatriazine-4,4-dioxide moiety, and the other comprises a naphthol or a pyrazolinone moiety.

This invention also provides a combination of a receiving sheet comprising a polymer having a plurality of first groups, and a donor sheet comprising an imaging reagent comprising a plurality of second groups, the imaging reagent being capable of diffusing from the donor sheet to the receiving sheet upon heating of the donor sheet, one of the first and second groups comprising a benzotriazinone moiety bearing an electron-withdrawing group at the 3-position, or a benzothiatriazine-4,4-dioxide moiety, and the other comprising a naphthol or a pyrazolinone moiety.

Finally, this invention provides a polymer comprising a main chain and a plurality of side chains each comprising a benzotriazinone moiety beating an electron-withdrawing group at the 3-position, or a benzothiatriazine-4,4-dioxide moiety.

DETAILED DESCRIPTION OF THE INVENTION

As already mentioned, the process of the present invention makes use of a polymer containing a plurality of first groups, and an imaging reagent containing second groups. When the imaging reagent is brought into imagewise contact with the polymer, the first and second groups react, forming a colored material and hence an image. One of the first and second groups is a benzotriazinone moiety bearing an electron-withdrawing group at the 3-position, or a benzothiatriazine-4,4-dioxide moiety, and the other is a naphthol or a pyrazolinone moiety. Since color formation results from condensation between the first and second groups, with the resulting condensed grouping remaining attached to the polymer, the colored material produced is itself polymeric, and hence is much less susceptible to diffusion within or out of the locus at which it is produced. Accordingly, the images produced by the present process should be less prone to loss of resolution or dye bleed than images produced by a conventional dye diffusion thermal transfer process.

Figure 1:
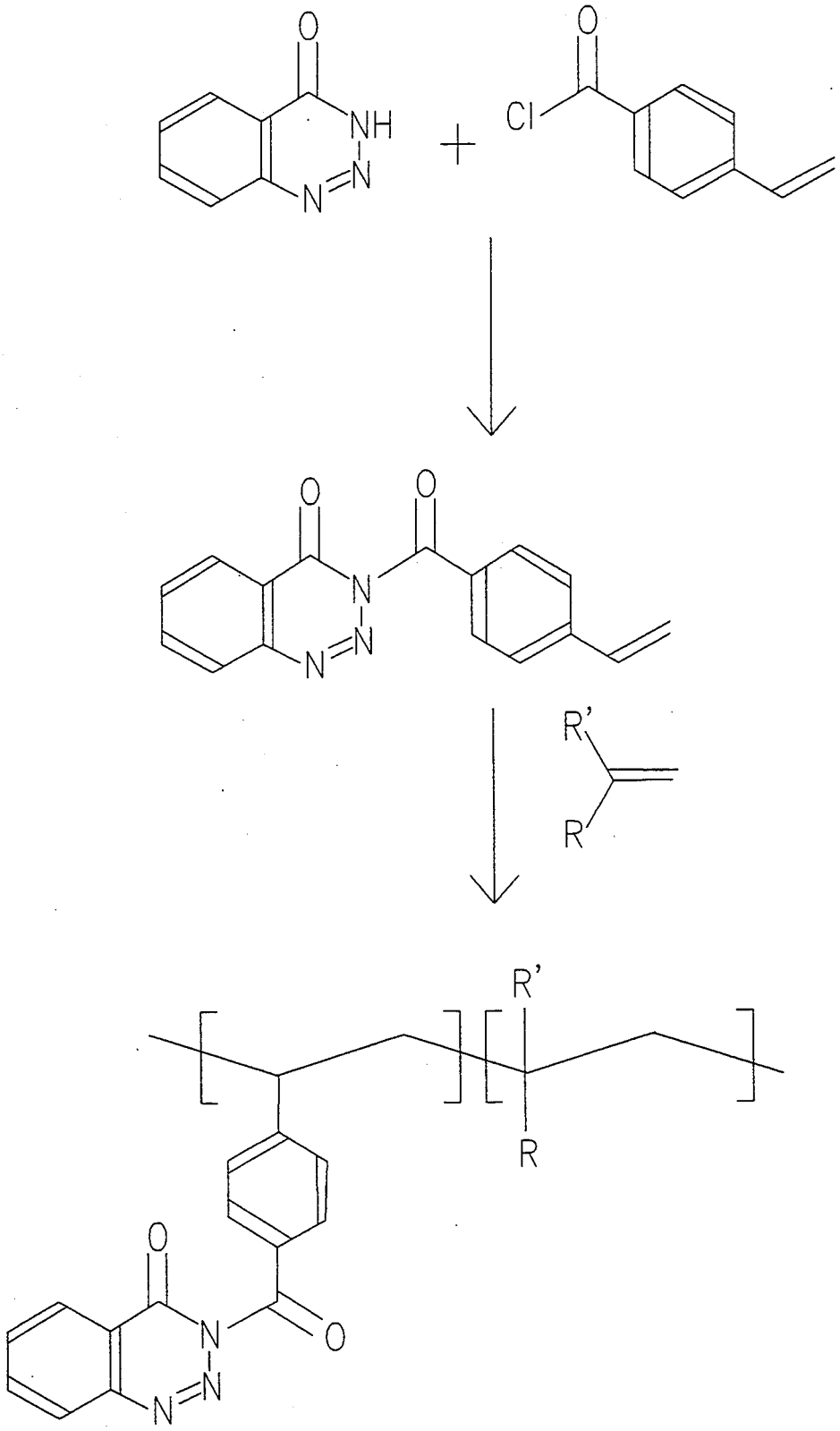
FIGS. 1 and 2 of the accompanying drawings show two preferred methods for synthesis of polymers useful in the process of the present invention.
Figure 2:
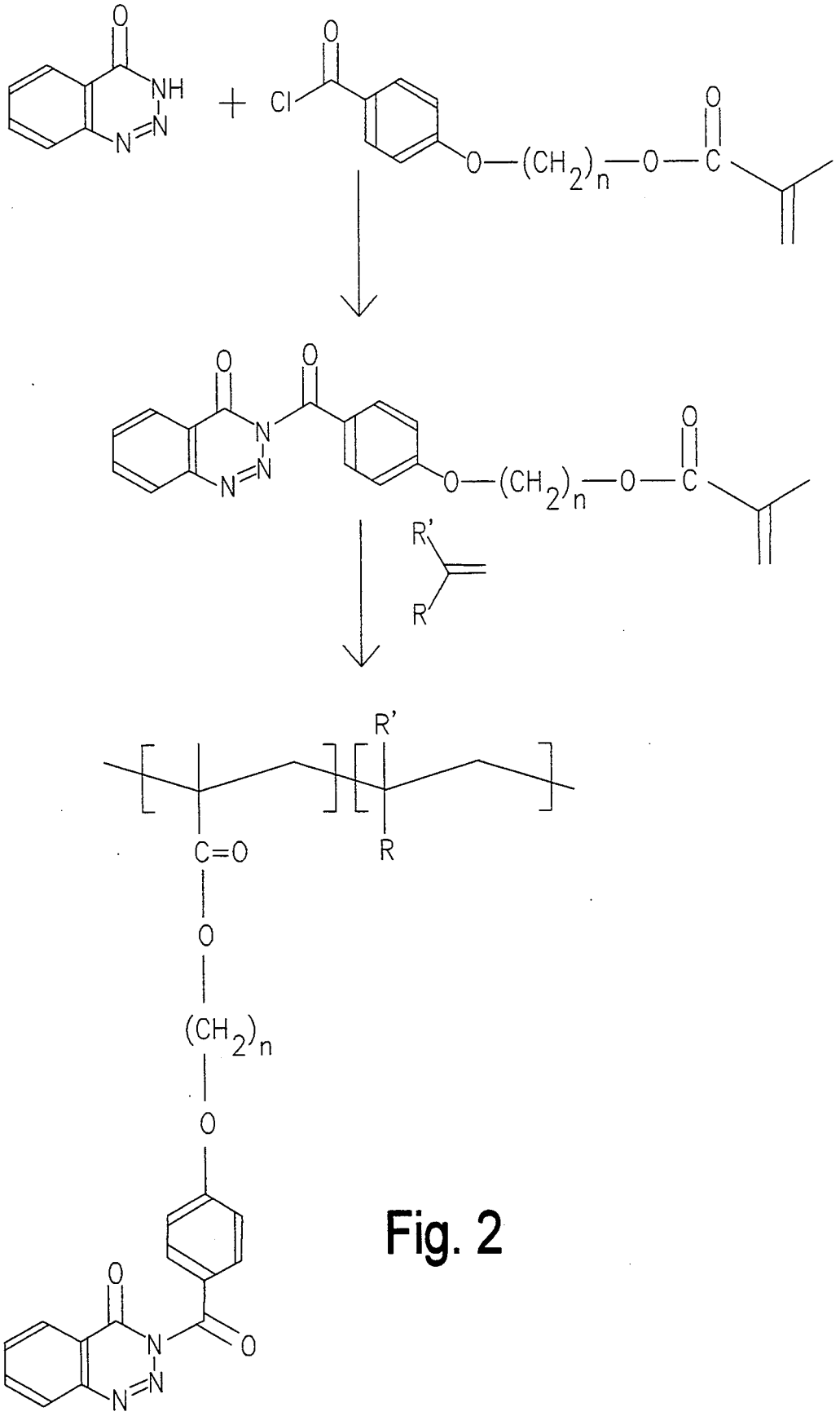

When the first or second group used in the present process is a benzotriazinone moiety, it has been found necessary that this moiety bear an electron-withdrawing group at its 3-position to provide sufficient reactivity. This electron-withdrawing group is preferably a carbonyl or —$SO_2$— group, although other electron-withdrawing groups may also be used. For example, FIGS. 1 and 2 illustrate benzotriazinone polymers in which the electron-withdrawing group is a carbonyl group. When the first or second group is a benzothiatriazine-4,4-dioxide moiety (for example, the analogues of the benzotriazinones shown in FIG. 1 in which the ring carbonyl group is replaced by an —$SO_2$— group), the moiety possesses sufficient reactivity without an electron-withdrawing group at the 3-position, although this invention does not exclude the possibility that such an electron-withdrawing group might be present. As discussed in more detail below, where a benzotriazinone moiety forms part of a sidechain in a polymer and is linked to the main chain of the polymer by a spacer group, the electron-withdrawing group can act as part of the spacer group.

In the present process, it is generally preferred that the first group (i.e., the group attached to the polymer) be a benzotriazinone or benzothiatriazine-4,4-dioxide moiety, since methods for the synthesis of polymers containing such moieties are well developed. More specifically, it is preferred that the polymer comprise a main chain, desirably a hydrocarbon main chain, and a plurality of side chains each comprising a benzotriazinone or benzothiatriazine-4,4-dioxide moiety. Although the benzotriazinone or benzothiatriazine-4,4-dioxide moieties may be attached directly to the main chain, it is preferred that a spacer group be interposed between the benzotriazinone or benzothiatriazine-4,4-dioxide moiety and the main chain, since the presence of such a spacer group tends to improve the reactivity of the polymer. Preferred spacer groups are benzoyl groups, alone or linked to ester groupings. Conveniently, the spacer group is attached the 3-position of the benzotriazinone or benzothiatriazine-4,4-dioxide moiety, since this position provides a convenient site for a reaction to attach the spacer group to the moiety, although we do not exclude the possibility of attachment at other positions. As already noted, where an electron-withdrawing group is required at the 3-position, this electron-withdrawing group may form part of the spacer group, so that attachment of the spacer group also inserts the electron-withdrawing group at the 3-position. For example, FIGS. 1 and 2 illustrate synthetic methods in which a 3-H benzotriazinone is reacted with a substituted benzoyl chloride to introduce at the 3-position both a carbonyl electron-withdrawing group and a spacer group.

Two preferred methods for the synthesis of polymers having a main chain and a plurality of side chains each comprising a spacer group and a benzotriazinone moiety are illustrated in FIGS. 1 and 2 of the accompanying drawings. In the synthetic method shown in FIG. 1, a benzo-1,2,3-triazin-4-one is reacted with 4-vinylbenzoyl chloride. Condensation occurs at the 3-position of the benzotriazinone to give a monomer in which the vinyl group is separated from the benzotriazinone moiety by a benzoyl spacer group. This monomer is then copolymerized with a substituted ethylene, for example styrene (R equals phenyl, R′ equals hydrogen in FIG. 1) or methyl methacrylate (R equals $CH_3COO$, R′ equals methyl), using a conventional free radical polymerization initiator (for example Vaso 52, available commercially from E. I. du Pont de Nemours, Inc., Wilmington, Del.) to yield a polymer of the invention having a hydrocarbon main chain bearing a plurality of side chains, each of which comprises a benzotriazinone moiety separated from the main chain by a benzoyl spacer group.

The second synthetic method, shown in FIG. 2, produces a polymer with a longer and more flexible spacer group. In this second method, the 4-vinylbenzoyl chloride used in the first method is replaced by a 4-methacroylalkoxybenzoyl chloride, in which the hydrocarbon portion of the alkoxy group contains from about 3 to about 6 carbon atoms (i.e., desirably n equals 3, 4, 5 or 6 in FIG. 2). Condensation again occurs at the 3-position of the benzotriazinone to give a monomer in which a vinyl group is separated from the benzotriazinone moiety by a carboxyalkoxy grouping. As in the first method, this monomer is copolymerized with a substituted ethylene to give the final polymer of the invention.

In these preferred methods for synthesis of the polymers of the invention, the ratio of the benzotriazinone-containing monomer to the comonomer(s) may be varied to alter the spacing between the benzotriazinone-containing side chains, and thus the number of color-forming sites and the maximum optical density ($D_{max}$) which can be achieved in a given layer of the polymer. The ability to vary the amount and type of comonomer(s) used to form the final polymer allows the properties of the polymer to be varied in several useful respects, for example solubility or dispersibility in solvents which may be used to form coating solutions or dispersions of the polymer for depositing a layer of the polymer on to a support. Also, more than one benzotriazinone-containing monomer may be used to form the polymer.

The naphthol used in the present process may be an $\alpha$- or $\beta$-naphthol conveniently a 4-alkoxy-$\alpha$-naphthol, one specific preferred naphthol being 4-isopropoxynaphth-1-ol, which has been found to give a desirable magenta color. Other naphthols described in the aforementioned U.S. Pat. No. 4,957,847 (for example the material known as "Naphthol AS," which is the N-phenylamide of 3-hydroxynaphth-2-oic acid), may also be used. Preferred pyrazolinones are 1-phenylpyrazolin-5-ones, especially 3-methyl- 1-phenylpyrazolin-5-one, which gives a desirable yellow color.

In the present process, the imagewise contact between the imaging reagent and the imaging medium may be effected in various ways. For example, a liquid containing the imaging reagent may be sprayed imagewise, by means of an ink jet head or similar apparatus, on to an imaging medium bearing a coating of the polymer, and the imaging medium thereafter uniformly heated to produce the image. Alternatively a first layer of the polymer may be laid down upon a support and a second layer of imaging reagent may be superposed on the first layer, and the resultant medium thereafter imagewise heated, by means of a thermal head or similar apparatus so that, in heated areas, the imaging reagent diffuses from the second layer into the first layer and forms a colored image. However, preferably the present process is carried out in a manner similar to a conventional dye diffusion thermal transfer process, with the polymer provided on a receiving sheet and the imaging reagent present on a donor sheet, and imaging is effected by imagewise heating the donor sheet to transfer the imaging reagent from the donor sheet to the receiving sheet, thus forming an image on the receiving sheet. This type of process has the advantage that, since the donor sheet is removed from the receiving sheet after imaging is complete, and discarded, there is no chance of later diffusion of imaging reagent into contact with the polymer and consequent unwanted color formation.

In certain cases, as demonstrated in the Examples below, the present process may be carried out using commercial equipment intended for conventional dye diffusion thermal transfer imaging, simply substituting the donor and receiving sheets of the present invention for the prior art dye diffusion thermal transfer donor and receiving sheets.

The following Examples are now given, though by way of illustration only, to show details of particularly reagents, conditions and techniques used in the imaging medium and process of the present invention.

EXAMPLE 1

This Example illustrates the preparation of the polymer shown in FIG. 1 of the accompanying drawings.

A solution of benzo-1,2,3-triazin-4-one (3.8835 g) in dry pyridine (40 mL) was stirred, and to this solution was added, over a period of 30 seconds, freshly prepared 4-vinylbenzoyl chloride (4.3945 g, prepared as described in Hirao et al., Macromolecules, 21, 561 (1988)). The resultant reaction mixture was stirred at room temperature for 1.5 hours, then poured into an ice/water mixture (300 mL). The colorless precipitate which formed was filtered off, washed with water on the frit and dried. The dried product was then dissolved in methylene chloride (75 mL) and the resultant solution was washed with water, dried over anhydrous magnesium sulfate and passed through a short column of silica gel. The solution was then concentrated on a rotary evaporator to give the desired 3-(vinylbenzoyl)-benzotriazinone product as a colorless solid (6.12 g) having melting point 120° C. The identity of the product was confirmed by proton nuclear magnetic resonance (NMR) and infra-red spectroscopy, the spectra being as follows:

$^1$H NMR (in $CDCl_3$) $\delta$=5.48 (doublet, 1H), 5.93 (doublet, 1H), 6.76 (double doublet, 1H), 7.55 (doublet, 2H), 7.9 (multiplet, 2H), 8.07 (quadruplet, 2H), 8.35 (doublet, 1H) and 8.40 (doublet, 1H).

Infra-red (KBr pellet) 3060, 1754, 1723, 1682, 1603, 1460, 1300, 1275, 1170, 1055, 1028, 913, 855, 778 and 710 $cm^{-1}$.

The 3-(vinylbenzoyl)benzotriazinone thus produced was copolymerized with styrene in the following manner. A 50 mL round-bottomed flask, equipped with a magnetic stirrer and a reflux condenser, was charged with the benzotriazinone (0.8747 g), styrene (1.5763 g), 2,2'-azobisisobutyronitrile (AIBN, 0.011 g, a free radical polymerization initiator) and dry tetrahydrofuran (20 mL). The flask was purged with nitrogen and the reaction mixture refluxed under nitrogen for 24 hours, then cooled to room temperature and added dropwise to vigorously stirred methanol (200 mL). The polymer which precipitated was filtered off, washed by stirring in warm methanol for 2.5 hours, again filtered off and washed with methanol in a Soxhlet apparatus overnight, then dried in vacuo at room temperature to give the final polymer (0.9589 g).

Thermogravimetric analysis of this polymer showed decomposition at about 299° C., while differential scanning calorimetry indicated a glass transition temperature of about 125° C. Gel permeation chromatography (GPC) using polystyrene standards indicated $M_w$=55,953, $M_n$=22,681.

EXAMPLE 2

This Example illustrates the preparation of the polymer shown in FIG. 2 of the accompanying drawings in which n is 4.

Part A

Preparation of 4-(4-methacryloxybutoxy)benzoyl chloride 4-(4-Hydroxybutoxy)benzoic acid (prepared by the method of Whitcombe et al., Polymer Comm., 32, 380–381 (1991)) was esterified with methacrylic acid by the method described in Portugall et al., Makromol. Chem 183, 2311 (1982) to give an oil which was precipitated into water, filtered, dried and recrystallized from 2-propanol to give 4-(4-methacryloxybutoxy)benzoic acid, melting point 103°–106° C. acid was converted to the desired acid chloride by the method described in the aforementioned Portugall et al. paper; the acid chloride was obtained as a clear, colorless oil, which was recrystallized from dry hexanes to give the final product (84% yield) as fluffy white needles, melting point 30°–31° C.

The proton NMR spectrum of the product in deuterochloroform was: $\delta$=1.9 (multiplet, 4H, Ar—O—$CH_2CH_2CH_2CH_2$—O), 2.0 (singlet, 3H, $CH_3$—C=C), 4.15 (triplet, 2H, Ar—O—$CH_2CH_2CH_2CH_2$—O), 4.25 (triplet, 2H, Ar—O—$CH_2CH_2CH_2CH_2$—O), 5.6 (singlet, 1H, CO—C=CH—H trans to CO), 6.1 (singlet, 1H, CO—C=CH cis to CO), 6.97 (doublet, 2H, Ar—H ortho to Ar—O) and 8.21 (doublet, 2H, Ar—H ortho to Ar—CO). Fast atom bombardment mass spectroscopy (FAB-MS) gave m/e 297 ($M^+$) and 261 ($M^+$—Cl), while the infrared spectrum (from a film cast on to an NaCl disc) showed peaks at 3050 (weak, Ar—H), 2980 (strong, aliphatic CH), 1775 (very strong, acid chloride C=O) and 1620 (medium, C=C) $cm^{-1}$.

Part B

Preparation of 4-(4-methacryloxybutoxy)benzoylbenzotriazinone

The acid chloride produced in Part A above was reacted with one equivalent of benzo[e]-1,2,3-triazin-4-one in freshly distilled pyridine for 1 hour. The reaction mixture was then poured into distilled water, and vacuum filtration was used to separate the crude product, which was recrystallized from ethyl acetate/hexanes to give the desired product, melting point 68°–70° C.

The proton NMR spectrum of the product in deuterochloroform was: $\delta$=1.9 (multiplet, 4H, Ar—O—$CH_2CH_2CH_2CH_2$—O), 2.0 (singlet, 3H, $CH_3$—C=C), 4.15 (triplet, 2H, Ar—O—$CH_2CH_2CH_2CH_2$—O), 4.25 (triplet, 2H, Ar—O—$CH_2CH_2CH_2CH_2$—O), 5.6 (singlet, 1H, CO—C=CH—H trans to CO), 6.1 (singlet, 1h, CO—C=CH cis to CO), 6.97 (doublet, 2H, Ar—H ortho to Ar—O), 7.95 (doublet, 2H, Ar—H ortho to Ar—CO), 8.05 (triplet, 2H, Ar—H), 8.25 (doublet, 1H, Ar—H) and 8.38 (doublet, 1H, Ar—H). (FAB-MS gave m/e 407 ($M^+$), while the infrared spectrum (KBr pellet) showed peaks at 3050 (weak, Ar—H), 2980 (strong, aliphatic CH), 1720 and 1690 (ester and imide C=O) and 1600 (medium, C=C) $cm^{-1}$. The ultra-violet/visible spectrum showed peaks at 266 ($\epsilon$=30,500) and 300 nm ($\epsilon$=21,900).

Part C

Copolymerization with methyl methacrylate

Copolymerization was carried out in an argon-flushed reaction vessel, equipped with a magnetic stirrer and a reflux condenser. This vessel was charged with equal molar equivalents of the monomer prepared in Part B above (4.0 g, 0.01 mole) and methyl methacrylate, (1.0 g, 0.01 mole), together with 50 mL of toluene, thus forming a 10% by weight solution of the monomers. The reaction solution was purged of oxygen by bubbling argon into the solution for 1 hour, then the solution was heated to 50° C. and 10% by weight of the aforementioned Vaso 52 initiator was added to the solution. After 20 hours refluxing the solution was poured into methanol and the white powder which precipitated was recovered by filtration. This polymer was washed with methanol and then dried in vacuo, to give a polymer having $M_w=40{,}700$, $M_n=22{,}600$, $M_W/M_n=1.8$ by GPC. The infrared spectrum (KBr pellet) showed peaks at 3050 (w, Ar—H). 2980 (s, aliphatic CH), 1720, 1690 (ester and imide C═O) and 1600 (m, C═C) $cm^{-1}$. The ultra-violet/visible spectrum showed peaks at 224 and 294 nm.

EXAMPLE 3

This Example illustrates an imaging process of the invention carded out using commercial apparatus designed for use in a conventional dye diffusion thermal transfer process.

A coating solution was prepared by dissolving 4-isopropoxynaphth-1-ol (0.5 g) and polycaprolactone (0.5 g) in chloroform (10 mL). This coating solution was spin coated on to a 12 μm polyester base and the coated base dried to produce a donor sheet, which was spliced into the web of a standard print cartridge for a Hitachi VY200 dye diffusion thermal transfer printer (available from Hitachi Ltd., Tokyo, Japan). A receiving sheet was prepared by coating a 10% chloroform solution of the polymer prepared in Example 2 above on to a 4 mil (101 μm) polyester base (Melinex 505, supplied by ICI Films, Hopewell, Va. 23860). The receiving sheet and the donor sheet were then imaged using a Hitachi VY200 dye diffusion thermal transfer printer, whereupon a magenta image was formed on the receiving sheet.

A second dye donor sheet was prepared in the same manner but substituting 3-methyl-1-phenylpyrazolin-5-one for the naphthol. Upon repeating the imaging process, a yellow image was formed upon the receiving sheet.

Finally, a receiving sheet was imaged in a two-step process using both the aforementioned donor sheets, and a two-color image (magenta and yellow) was produced upon the receiving sheet.

From the foregoing, it will be seen that the present invention provides an image process, and a medium for use therein, which avoid the difficulties caused by dye diffusion within, and dye bleed from, the receiving sheets of conventional dye diffusion thermal transfer processes.

We claim:

1. A process for forming an image, which process comprises:

providing an imaging medium comprising a polymer having a plurality of first groups; and imagewise contacting the polymer with an imaging reagent comprising a plurality of second groups, thus causing, in the areas of the medium exposed to the imaging reagent, the second groups to react with the first groups and form a colored material, and thereby forming an image on the imaging medium, wherein one of the first and second groups is selected from the group consisting of benzotriazinone moieties bearing an electron-withdrawing group at the 3-position and benzothiatriazine-4,4-dioxide moieties and the other of the first and second groups comprises a naphthol or a pyrazolinone moiety.

2. A process according to claim 1 wherein the electron-withdrawing group is a carbonyl or —$SO_2$— group.

3. A process according to claim 1 wherein the first group comprises a benzotriazinone or benzothiatriazine-4,4-dioxide moiety.

4. A process according to claim 3 wherein the polymer comprises a main chain and a plurality of side chains each comprising a benzotriazinone or benzothiatriazine-4,4-dioxide moiety.

5. A process according to claim 4 wherein at least some of the side chains comprise a spacer group between the benzotriazinone or benzothiatriazine-4,4-dioxide moiety and the main chain.

6. A process according to claim 5 wherein the spacer group comprises a benzoyl group.

7. A process according to claim 1 wherein the naphthol is an alkoxy-substituted naphthol.

8. A process according to claim 7 wherein the naphthol is a 4-alkoxy-α-naphthol.

9. A process according to claim 1 wherein the pyrazolinone is a 1-phenylpyrazolin-5-one.

10. A process according to claim 1 wherein the polymer is provided in a receiving sheet, the imaging reagent is present in a donor sheet and the donor sheet is imagewise heated to transfer the imaging reagent from the donor sheet to the receiving sheet, thereby forming an image on the receiving sheet.

11. In combination, a receiving sheet comprising a polymer having a plurality of first groups, and a donor sheet comprising an imaging reagent comprising a plurality of second groups, the imaging reagent being capable of diffusing from the donor sheet to the receiving sheet upon heating of the donor sheet, one of the first and second groups being selected from the group consisting of benzotriazinone moieties bearing an electron-withdrawing group at the 3-position and benzothiatriazine-4,4-dioxide moieties and the other of the first and second groups comprising a naphthol or a pyrazolinone moiety.

12. A receiving sheet and a donor sheet according to claim 11 wherein the electron-withdrawing group is a carbonyl or —$SO_2$— group.

13. A receiving sheet and a donor sheet according to claim 11 wherein the first group comprises a benzotriazinone or benzothiatriazine-4,4-dioxide moiety.

14. A receiving sheet and a donor sheet according to claim 13 wherein the polymer comprises a main chain and a plurality of side chains each comprising a benzotriazinone or benzothiatriazine-4,4-dioxide moiety.

15. A receiving sheet and a donor sheet according to claim 14 wherein at least some of the side chains comprise a spacer group between the benzotriazinone or benzothiatriazine-4,4-dioxide moiety and the main chain.

16. A receiving sheet and a donor sheet according to claim 11 wherein the naphthol is an alkoxy-substituted naphthol.

17. A receiving sheet and a donor sheet according to claim 11 wherein the pyrazolinone is a 1-phenylpyrazolin-5-one.

* * * * *